United States Patent [19]

Hancock et al.

[11] Patent Number: 4,852,495

[45] Date of Patent: Aug. 1, 1989

[54] SHAPED CHARGE DETONATING CORD RETAINER ARRANGEMENT

[75] Inventors: Michael P. Hancock, Cleburne; Scott L. Hayes, Mansfield, both of Tex.

[73] Assignee: Goex, Inc., Cleburne, Tex.

[21] Appl. No.: 157,379

[22] Filed: Feb. 17, 1988

[51] Int. Cl.[4] ..... F42B 1/02

[52] U.S. Cl. ..... 102/306; 102/307; 102/312; 102/313; 102/275.7; 102/275.8

[58] Field of Search ..... 102/306, 307, 312, 313, 102/275.7, 275.8

[56] References Cited

U.S. PATENT DOCUMENTS

| | | | |
|---|---|---|---|
| 3,143,068 | 8/1964 | Bell | 102/20 |
| 3,444,810 | 9/1967 | Hakala | 102/20 |
| 3,650,212 | 3/1972 | Bauer | 102/20 |
| 3,951,218 | 4/1976 | Sjogren | 102/24 X |
| 4,312,273 | 1/1982 | Camp | 102/310 |
| 4,326,462 | 4/1982 | Garcia et al. | 102/310 |
| 4,393,964 | 7/1983 | Pottier | 175/4.56 |
| 4,428,440 | 1/1984 | McPhee | 102/310 X |
| 4,519,313 | 5/1985 | Leidel | 102/310 X |
| 4,681,037 | 7/1987 | Regalbuto | 102/310 |

*Primary Examiner*—Peter A. Nelson

*Attorney, Agent, or Firm*—Arthur F. Zobal; James C. Fails; Geoffrey A. Mantooth

[57] ABSTRACT

There is disclosed an easy to assembly detonating cord retainer arrangement for shaped charges. A portion of a length of detonating cord is laid into the slot of a bifurcated cylindrical projection located at one end of the shaped charge case. A push nut is pressed onto the projection to retain the detonating cord within the slot.

21 Claims, 1 Drawing Sheet

Fig. 1
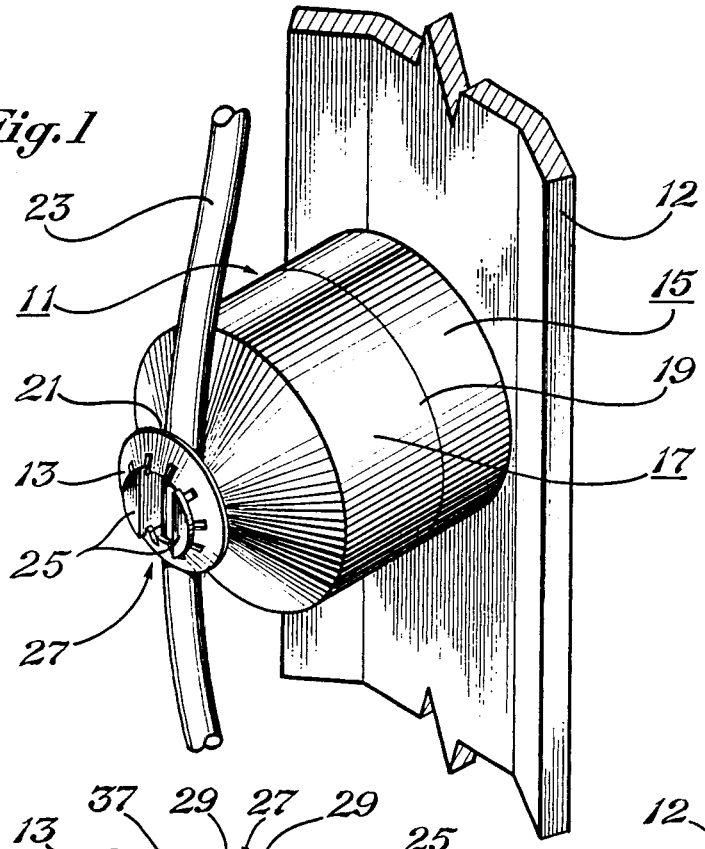
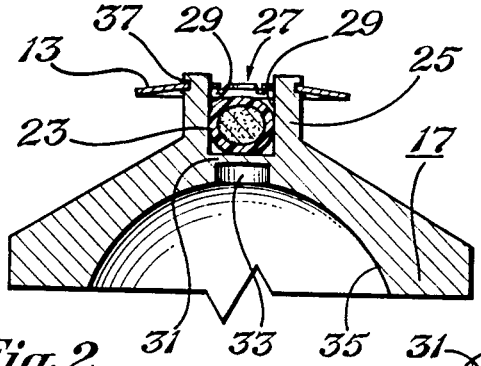
Fig. 2
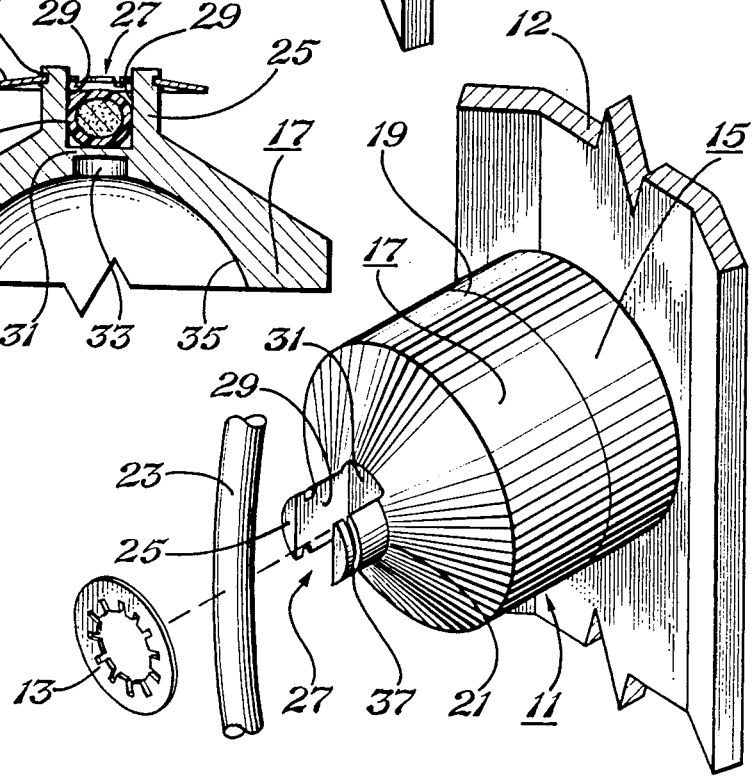
Fig. 3

SHAPED CHARGE DETONATING CORD RETAINER ARRANGEMENT

FIELD OF THE INVENTION

The present invention relates to shaped charge well perforating apparatuses, and in particular to detonating cord retainer arrangements for shaped charges.

BACKGROUND OF THE INVENTION

Well perforating apparatuses typically utilize shaped charges for perforating well casing. The individual shaped charges are detonated with detonating cord, which cord is retained adjacent to one end of the respective shaped charge cases by some retainer means.

There are numerous types of prior art detonating cord retainer arrangements all of which are subject to some short comings. One such prior art arrangement involves a cylindrical opening in the respective end of a shaped charge case, which opening receives the detonating cord. The detonating cord is assembled on the shaped charge case by threading the cord through the opening, a somewhat delicate and time consuming task. Another prior art arrangement involves the use of relatively expensive custom designed and custom-made clips for retaining the detonating cord. The clips, which are easily lost in the field, are difficult to replace from local sources. An assembler of a well perforating apparatus who is in need of replacement clips must resort to ordering the clips from the manufacturer.

SUMMARY OF THE INVENTION

It is an object of the present invention to provide a detonating cord arrangement that is not subject to the disadvantages of the prior art.

The detonating cord retainer arrangement of the invention comprises a shaped charge case and a retainer means. One end of the shaped charge case has a bifurcated projection, which forms a slot for receiving a portion of a length of detonating cord. The slot allows the detonating cord to be placed contiguous to means for interfacing the detonating cord portion to an explosive charge in the shaped charge case. The retainer means is pressed onto the projection and once on, resists coming off of the projection. The retainer means retains the detonating cord portion in the slot.

In another aspect, the retainer means is a push nut. In still another aspect, the projection portion is provided with a circumferential groove for receiving and capturing the retaining means.

BRIEF DESCRIPTION OF THE DRAWINGS

FIG. 1 is a schematic isometric view showing the detonating cord arrangement of the present invention, in accordance with the preferred embodiment.

FIG. 2 is a schematic longitudinal cross sectional view of the detonating cord end portion of the shaped charge case of FIG. 1.

FIG. 3 is a schematic exploded isometric view of the detonating cord arrangement of FIG. 1.

DESCRIPTION OF THE PREFERRED EMBODIMENT

In the drawings, there is shown a shaped charge 11 mounted onto a shaped charge carrier 12. In addition to the shaped charge 11 shown in the drawings, there are usually a plurality of other similar shaped charges mounted onto the same shaped charge carrier 12. Such an assembly of shaped charges on a carrier is used to perforate well casing in an oil or gas well.

The shaped charge 11 incorporates the detonating cord retainer arrangement of the present invention, in accordance with a preferred embodiment. The detonating cord retaining arrangement of the present invention includes portions of the shaped charge 11 and a retainer means 13.

The shaped charge 11 includes a cap 15 and a case 17. The cap 15, which is conventional, has a threaded member (not shown) which matingly engages a threaded opening (not shown) in the carrier 12 to mount the shaped charge 11 onto the carrier.

The shaped charge case 17 has first and second ends 19, 21. The first end 19 of the case is conventional and is coupled to the cap 15 in a conventional manner. The coupling allows the case 17 to be rotated relative to the cap 15. The second end 21 of the case 17 has provision for receiving a portion of a length of detonating cord 23. The second end 21 has a projection 25 that extends in a direction opposite to the first end 19 of the case 17. The projection 25, which is cylindrical, is bifurcated to form a slot 27 having sides 29. At the closed end of the slot 27 is means for interfacing the detonating cord 23 to the explosive charge (not shown) located inside of the case 17. In the preferred embodiment, the interface means is a booster wall 31. The booster wall 31 separates the portion of the detonating cord 23 located in the slot 27 from a booster hole 33, which receives a booster charge (not shown). The booster hole 33 opens to a cavity 35 inside of case 17, which cavity receives the explosive charge. The width of the slot 27 (the distance between the slot sides 29) is only very slightly greater than the diameter of the detonating cord 23 to insure an interference fit between the detonating cord and the slot sides. The depth of the slot 27 (the distance from the booster wall 31 to the free end of the projection 25) is such that the detonating cord 23 can be positioned contiguous to the booster wall 31, while allowing the retainer means 13 to be pressed onto the projection 25. Near the free end of the projection 25 is a circumferential groove 37, for receiving and capturing the retainer means 13.

In the preferred embodiment, the retainer means is a conventional spring metal push nut 13. The push nut 13 is pressed onto the projection 25, where once on, it resists coming off.

The assembly and retention of the detonating cord 23 onto the shaped charge 11 is quick and simple. With the shaped charge 11 mounted onto the carrier 12 as shown in the drawings, the case 17 is rotated relative to the cap 15 to bring the slot 27 in parallel alignment with the carrier 12. This allows the detonating cord 23 to be assembled onto the shaped charges so as to run parallel to the carrier 12. Next, a portion of a length of detonating cord 23 is laid into the slot 27, such that the detonating cord portion contacts the booster wall 31. Then, the push nut 13 is pressed onto the projection 25 until the push nut is received and captured by the circumferential groove 37.

As can be seen in FIG. 2, when the push nut 13 is pushed onto the projection, the outer periphery of the push nut flexes towards the booster wall 31. This flexing forces the detonating cord 23 into intimate contact with the booster wall 31, thereby insuring the detonation of the explosive charge.

The push nut can be utilized on a projection that does not have a circumferential groove. For such a projection, the push nut still resists coming off of the projection. A circumferential groove is favored if the projection is made of a relatively soft material such as zinc to insure the retention of the push nut.

Although the retainer means has been described as a push nut, alternative types of retainer means could be used, so long as the retainer means can be pressed onto the cylindrical projection and resists coming off of the projection either by itself or with the assistance of a circumferential groove. For example, an elastomeric O-ring could serve as a retainer means.

Although the interface means has been described as a booster wall, the interface means could be a port or opening, wherein the detonating cord directly contacts an explosive.

An important aspect of the present invention is the ease and simplicity of retaining the detonating cord to a shaped charge. The detonating cord is merely laid into the slot of a bifurcated cylindrical projection and the push nut is pushed onto the projection.

Another important aspect of the present invention is the use of a standard readily available component for retaining the detonating cord. Unlike the custom-made retaining clips of the prior art, substitute push nuts can be procured at most hardward stores, thus making the loss of the retainer means in the field only a minor inconvenience instead of a major catastrophe.

The foregoing disclosure and the showing made in the drawings are merely illustrative of the principles of this invention and are not to be interpreted in a limiting sense.

We claim:

1. A detonating cord retainer arrangement for a shaped charge, comprising:

a shaped charge case, said shaped charge case having an end for receiving a portion of a length of detonating cord, said shaped charge case end having interface means for interfacing said detonating cord portion to an explosive charge in said shaped charge case, said shaped charge case end having a projection projecting from said end, said projection being bifurcated to form a slot for receiving said detonating cord portion, said slot allowing said detonating cord portion to be placed contiguous to said interface means;

an annular retainer means having an opening for receiving said projection for retaining said detonating cord portion in said slot and contiguous to said interface means.

2. The arrangement of claim 1, wherein said projection is cylindrical and said retainer means comprises a push nut having an opening for receiving said projection.

3. The arrangement of claim 1, wherein said projection has a circumferential groove for receiving and capturing said retainer means.

4. The arrangement of claim 2, wherein said projection has a circumferential groove for receiving and capturing said retainer means.

5. A detonating cord retainer apparatus for a shaped charge comprising:

a shaped charge case for holding an explosive charge, said shaped charge case having a first end and a second end spaced from said first end, two spaced apart projection means coupled to said second end of said shaped charge case and extending away from said second end terminating in two spaced apart free ends forming a slot which extends from said free ends toward said second end for receiving a portion of a detonating cord, each of said spaced apart projection means having an outer side wall means and an inner side wall means with said inner side wall means of said two spaced apart projection means facing each other, said slot being defined as having two spaced apart side openings and an opening at said free ends whereby a detonating cord portion may be located in said slot from said opening at said free end to extend through said slot by way of said two side openings, and retainer means having an opening for receiving said two spaced apart projection means such that said retainer means may be located at least partially around said outer side wall means of said two spaced apart projection means and positioned between said detonating cord portion, when located in said slot, and said free ends and across at least one of said side openings of said slot for retaining said detonating cord portion in said slot for allowing said detonating cord to be used for detonating said explosive charge.

6. The apparatus of claim 5 wherein:

said inner wall means of said two projection means extend transverse to a plane extending through said shaped charge case at a position between and spaced from said first and second ends of said shaped charge case.

7. The apparatus of claim 5 wherein:

said retainer means comprises an annular retainer means having an opening for receiving said two projection means such that said annular retainer means may be located around said two projection means and positioned between said detonating cord portion, when located in said slot, and said free ends and across said two side openings of said slot.

8. The apparatus of claim 7 wherein:

said annular retainer means comprises a flexible disc like member which when located around said two projection means, the outer periphery of said disc like member may be located closer to said second end than the inner periphery of said flexible disc like member.

9. The apparatus of claim 7 comprising:

groove means formed in said outer side wall means of said two projection means between said second end and said free ends for receiving at least the inner edge of said annular retainer means.

10. The apparatus of claim 8 comprising:

groove means formed in said outer side wall means of said two projection means between said second end and said free ends for receiving the inner edge of said flat disc like retainer means.

11. The apparatus of claim 6 wherein:

said retainer means comprises an annular retainer means having an opening for receiving said two projection means such that said annular retainer means may be located around said two projection means and positioned between said detonating cord portion, when located in said slot, and said free ends and across said two side openings of said slot.

12. The apparatus of claim 7 wherein:

said annular retainer means comprises a flexible disc like member which when located around said two projection means, the outer periphery of said disc like member may be located closer to said second end than the inner periphery of said flexible disc like member.

13. The apparatus of claim 11 comprising:

groove means formed in said outer side wall means of said two projection means between said second end and said free ends for receiving at least the inner edge of said annular retainer means.

14. The apparatus of claim 12 comprising:

groove means formed in said outer side wall means of said two projection means between said second end and said free ends for receiving the inner edge of said flexible disc like member.

15. The apparatus of claim 5 wherein:

said second end of shaped charge case has interface means for interfacing said detonating cord portion to the explosive charge in said shaped charge case with said slot allowing said detonating cord portion to be placed contiguous to said interface means.

16. The apparatus of claim 15 wherein:

said inner wall means of said two projection means extend transverse to a plane extending through said shaped charge case at a position between and spaced from said first and second ends.

17. The apparatus of claim 16 wherein:

said retainer means comprises an annular retainer means having an opening for receiving said two projection means such that said annular retainer means may be located around said two spaced apart projection means and positioned between said detonating cord portion, when located in said slot, and said free ends and across said two side openings of said slot.

18. The apparatus of claim 17 comprising:

groove means formed in said outer side wall means of said two projection means between said second end and said free ends for receiving at least the inner edge of said annular retainer means.

19. The apparatus of claim 18 wherein:

said annular retainer means comprises a flat disc like, flexible, metal push nut which when located around said two projection means, the outer periphery of said flat disc like, flexible, metal push nut may be located closer to said second end than the inner periphery of said flat disc like, flexible, metal push nut.

20. The apparatus of claim 5, comprising:

groove means formed in said outer side wall means of said two projection means between said second end and said free ends for receiving at least a portion of said retainer means.

21. The apparatus of claim 9, comprising:

a detonating cord portion located in said slot between said groove means of said two projection means and said second end, with said detonating cord portion extending through said slot by way of said two side openings, said annular retainer means being located around said two projection means with the inner edge of said annular retainer means located in said groove means of said two projection means.

* * * * *